US006439576B1

(12) United States Patent
Montague

(10) Patent No.: US 6,439,576 B1
(45) Date of Patent: Aug. 27, 2002

(54) ELECTRONIC MISSILE LOCATION

(75) Inventor: Charles E. Montague, St. Charles, IL (US)

(73) Assignee: Merlin Technologies, Inc., Rockford, IL (US)

( * ) Notice: Subject to any disclaimer, the term of this patent is extended or adjusted under 35 U.S.C. 154(b) by 213 days.

(21) Appl. No.: 09/124,871

(22) Filed: Jul. 30, 1998

(51) Int. Cl.[7] ..... A63F 13/00
(52) U.S. Cl. ..... 273/371; 463/52; 463/53
(58) Field of Search ..... 273/371–375, 273/377, 403, 404, 408, 416; 463/49–57; 324/529, 530, 608, 609

(56) References Cited

U.S. PATENT DOCUMENTS

| | | | | | |
|---|---|---|---|---|---|
| 2,076,357 | A | * | 4/1937 | Tempest | 273/371 |
| 3,112,110 | A | | 11/1963 | Schulman | |
| 4,057,251 | A | | 11/1977 | Jones et al. | |
| 4,244,583 | A | | 1/1981 | Wood et al. | |
| 4,678,194 | A | | 7/1987 | Bowyer et al. | |
| 4,768,789 | A | * | 9/1988 | Clark | 273/371 |
| 4,950,987 | A | * | 8/1990 | Vranish et al. | 324/207.23 |
| 5,209,491 | A | * | 5/1993 | Dodge | 273/371 |
| 5,442,313 | A | * | 8/1995 | Santos et al. | 327/355 |
| 5,462,283 | A | | 10/1995 | Allen | |
| 5,486,007 | A | * | 1/1996 | Stewart et al. | 273/374 |
| 5,540,445 | A | * | 7/1996 | Lee | 273/371 |
| 5,566,951 | A | * | 10/1996 | Dart et al. | 273/358 |
| 5,662,333 | A | | 9/1997 | Allen | |
| 5,681,004 | A | * | 10/1997 | Houriet, Jr. et al. | 273/371 |
| 5,897,116 | A | * | 4/1999 | Yiu | 273/408 |
| 5,987,349 | A | * | 11/1999 | Schultz | 600/427 |

FOREIGN PATENT DOCUMENTS

| | | | |
|---|---|---|---|
| DE | 88065804 | | 12/1988 |
| EP | 0082715 | * | 6/1983 |
| EP | 0181420 A1 | * | 5/1986 |
| EP | 0737842 A2 | * | 10/1996 |
| GB | 2030877 | | 4/1980 |
| GB | 2086243 | | 5/1982 |
| GB | 2122504 | * | 1/1984 |
| GB | 2198656 | | 6/1988 |
| WO | WO 8705688 | * | 9/1987 |
| WO | WO 95/04251 | * | 2/1995 |
| WO | WO9504912 | | 2/1995 |

OTHER PUBLICATIONS

Eric B. Pearson, Techmology of Instrumentation,Sep. 9, 1958, pp. 7,8, and 17–20.*

* cited by examiner

*Primary Examiner*—Jessica Harrison
*Assistant Examiner*—John M Hotaling, II
(74) *Attorney, Agent, or Firm*—Cook, Alex, McFarron, Manzo, Cummings & Mehler, Ltd.

(57) ABSTRACT

A system for the accurate electronic detection and location of missiles, such as darts, is disclosed in which electromagnetic radiation is transmitted through a dart board to signal receiving elements positioned on the side of the dart board opposite the target face and the change in electromagnetic signal is detected when a dart is embedded in one of the dart board target areas. The larger signal receiving elements of the dart board are divided into signal sensing portions which are electrically distinct from adjacent smaller signal receiving elements of the target and also the remainder of the total area of the larger signal receiving element, and the sensing portions are located adjacent the smaller signal receiving elements of the target to improve the accuracy and reliability of the electrical scoring of the darts which become embedded in or close to the smaller signal receiving elements.

8 Claims, 1 Drawing Sheet

ELECTRONIC MISSILE LOCATION

BACKGROUND AND SUMMARY OF INVENTION

The present invention relates to the electronic detection and location of darts or other missiles which are embedded in discreet scoring segments or areas of a target, such as in a conventional fiber or bristle dart board.

Various approaches have been taken in the past to automatically detect and electronically or electrically score games which employ a projectile which is to be propelled toward some form of target having areas denominated in different scores. One example of such game is the game of darts in which a dart is thrown at a dart board having plural segmented target areas of differing scores and multiples of those scores. Depending upon which target area the dart becomes embedded in, the game player is credited with the score or a multiple of the score for that area. Some of the target areas on the dart board are substantially smaller than other areas on the dart board, and if a dart becomes embedded in one of these smaller target areas, the score of the person who has thrown that dart is doubled or tripled.

One system which has been employed in the past to electronically score dart games which can utilize a conventional sisal fiber dart board is disclosed in U.S. Pat. No. 5,662,333 to Allen. The system disclosed in that patent relies on a principle of interference with electromagnetic radiation by an embedded dart, as opposed to other systems in which the dart itself acts as part of a transmitting/receiving electromagnetic radiation antenna. Although the system disclosed in that patent enjoys advantages over other earlier systems, there is still substantial room for improvement in the reliability and accuracy of the electronic scoring. In particular, it has been found that undesirable errors may occur in the electronic scoring where the dart may become embedded either in the large single scoring target area of the dart board but very close to the much smaller double or triple scoring area or vice versa and/or where the dart which is embedded at the last mentioned locations is only embedded to a shallow depth rather than a deep depth or vice versa. In these instances, loss of accuracy and reliability of scoring may be experienced. It is the purpose of the present invention to substantially improve the accuracy and reliability of such electronic scoring particularly in such instances as just described.

In one principal aspect of the present invention, a system for the accurate location of a missile embedded in a target comprises a target having a target face, which has a plurality of target areas formed of material into which one or more of the missiles may be selectively embedded. The target areas include a first target area which has a first magnitude of area size and a second target area which is adjacent to the first target area and which has a second magnitude of area size which is substantially larger than the first magnitude of area size. Signal receiving elements are associated with respective ones of the target areas for receiving and sensing electromagnetic signals which are received at each of the target areas when a missile is embedded in or near respective ones of the target areas. The signal receiving elements are positioned on a side of the material opposite the target face and substantially conform in size and shape to each of the target areas. The signal receiving element of the first target area has an area size which is substantially equal in magnitude to the first magnitude of area size, and the signal receiving element of the substantially larger second target area has a total area size which is substantially equal to the second magnitude of area size, but includes a signal sensing portion which is electrically distinct from the signal receiving element of the first target area and also electrically distinct from the remainder of the total area of the signal receiving element of the second target area. A processing means is electrically connected to the signal receiving elements and the sensing portion which is electrically distinct from the remainder of the total area of the signal receiving element of the second target area, and the processing means distinguishes between a first electromagnetic signal which is received and sensed by one of the signal receiving elements or the signal sensing portion, and a second electromagnetic signal which results from the presence of a missile in close proximity to the target area of the one of the signal receiving elements or the sensing portion, wherein the close proximity of the missile permits the accurate detection of the location of the missile.

In another principal aspect of the present invention, the aforementioned electrically distinct signal sensing portion of the signal receiving element of the second target area is adjacent to the signal receiving element of the first target area.

In still another principal aspect of the present invention, the magnitude of the area size of the electrically distinct signal sensing portion is substantially equal to the first magnitude of area size.

In still another principal aspect of the present invention, the aforementioned target is a dart board.

In still another principal aspect of the present invention, the first target area of the dart board is an area in which a double or triple score is awarded if a dart is embedded in the first target area, and the second target area is an area in which only a single score is awarded if a dart is embedded in the second target area.

These and other objects, features and advantages of the present invention will be more clearly understood through a consideration of the following detailed description.

BRIEF DESCRIPTION OF THE DRAWING

In the course of this description, reference will frequently be made to the attached drawing in which.

DESCRIPTION OF THE PREFERRED EMBODIMENT

Figure 1:
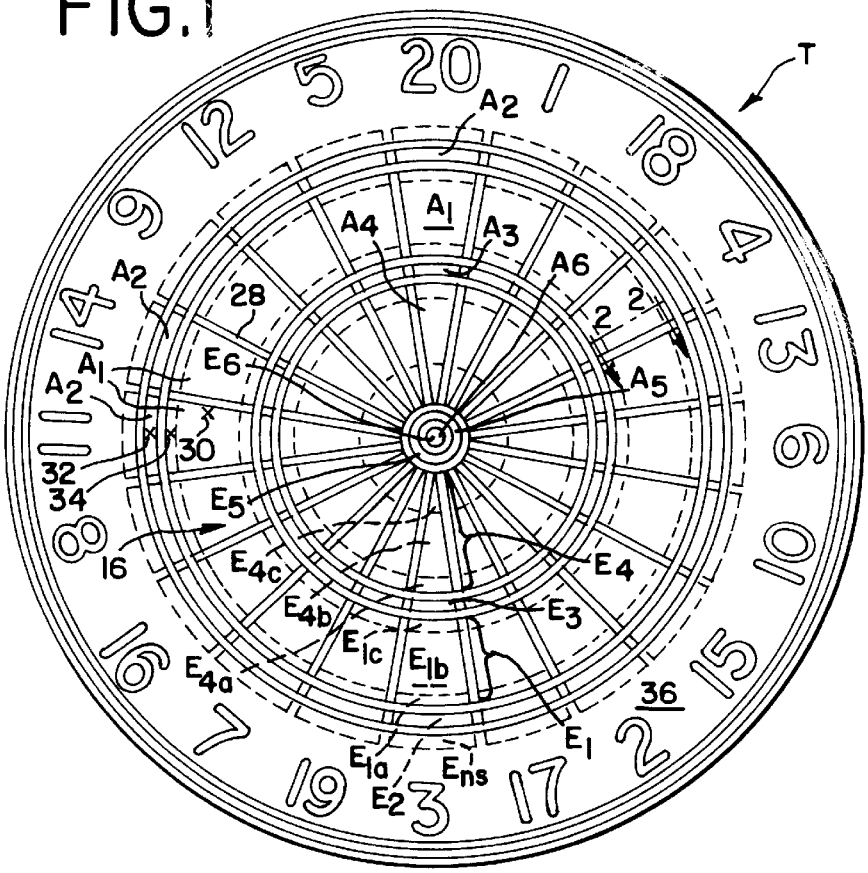
FIG. 1 is a overall frontal plan view of a dart board incorporating a preferred embodiment of the present invention.

As previously mentioned, the present invention relates to the automatic detection and location of a missile or projectile relative to a target, and the electrical or electronic scoring thereof. As shown in FIG. 1, the target may be a dart board T which has a plurality of discreet segmented target scoring areas $A_1$, $A_2$, $A_3$, $A_4$, $A_5$, etc. and which scoring areas have preselected but differing score point values. For example, as viewed in FIG. 1, if a dart becomes embedded in the scoring area $A_1$ or $A_4$, the player will be accorded a single score value depending upon the pie-shaped segment in which the target area is located, for example a score of "20" as shown in FIG. 1. If the dart lands in target area $A_2$,the score will be doubled for example 2×"20" as shown in FIG. 1, and if the dart lands in target area $A_3$ the score will be tripled, for example 3×"20" as viewed in FIG. 1. If the dart lands in scoring area $A_5$ which is the bulls eye, the player will receive a score of 25, and if it lands in the double bull scoring area $A_6$, the player will receive a score of 50 in the typical dart game.

Figure 2:
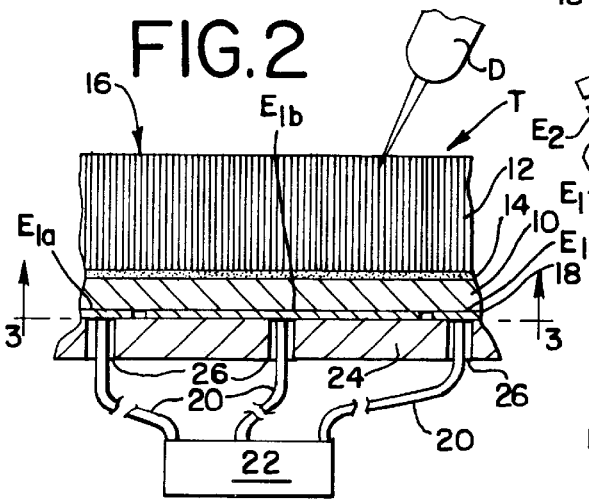
FIG. 2 is a broken, cross-sectioned elevation view of the dart board as viewed substantially along lines 2—2 of FIG. 1.

Referring particularly to FIG. 2, the dart board T is preferably of relatively conventional construction, for example of a conventional wood or chip board base 10 which is electrically insulative in nature and having a plurality of organic sisal fibers 12 fixed by an adhesive 14 to the front face of the base 10. The sisal fibers 12 extend frontally and outwardly from the base 10 and they are typically sheared to present a flat target front face 16 for receipt of darts D which are to be embedded therein during the game play as seen in FIG. 2.

Figure 3:
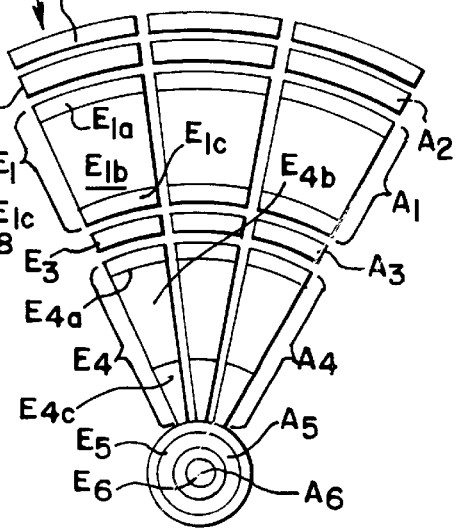
FIG. 3 is a partial, enlarged plan view from the rear of the dart board of three of the dart board scoring segments and their signal receiving elements, as viewed substantially along line 3—3 of FIG. 2.

Also as seen in FIG. 2, a plate 18 is positioned on the rear face of the chip board 10. The plate 18 is preferably formed of a non-conductive polymer to which segmented coatings or plates of conductive material, such as copper or the like, have been applied. These electrically conductive areas of coating or plates form signal receiving elements, such as elements $E_1$–$E_5$ as seen in FIG. 3, which in general conform to the size, configuration and shape of the target areas $A_1$–$A_5$, and which receive electromagnetic signals from a remote transmitting antenna (not shown), as more concisely described in the aforementioned U.S. Pat. No. 5,662,333 to Allen. To the extent which may be needed for a full description of the present invention, the disclosure of that patent to Allen is incorporated herein by reference. The conductive signal receiving elements $E_1$–$E_5$ in turn are connected by conductors 20 to a microprocessor 22 for processing signals, such as voltage signals, from each of the respective elements on the dart board, also as described in the Allen patent.

Additionally, the back of the dart board may also include a further protective layer 24 of polymer or chip board having openings 26 therethrough for the passage of the conductors 20, as seen in FIG. 2. It will also be appreciated that as in a conventional dart board, after the fibers 12 have been fixed to the chip board base 10 and sheared as necessary to form flat target front face 16, the several scoring areas $A_1$–$A_5$ are defined by isolating and separating the front face 14 into the segments or areas by pressing a preformed, preferably molded plastic electrically insulative spider 28 into the fibers from the target front face 16 as seen in FIG. 1.

The operation of the detection and location system as thus far described is generally as follows. The target or dart board T at all times will be bathed in and illuminated by a source of electromagnetic energy. This energy will pass through the dart board material including the sisal fibers 12, the adhesive layer 14 and the chip board base 10, and be received and sensed by the several signal receiving elements $E_1$–$E_5$. The signals which are sensed will pass through the conductors 20 and to the signal processor such as the microprocessor 22. Before the dart game is commenced and any missiles or darts D have been thrown, these signals will be sensed to be those of the uninterrupted electromagnetic signals from the signal generating source (not shown), such as a 125 KHz signal generator.

When a dart D is thrown and becomes embedded in the dart board bristles 12, as shown in FIG. 2, any electromagnetic responsive materials, such as steel, from which either or both the dart body or tip are formed, will interfere with the incoming electromagnetic signal that is being received by the signal receiving elements $E_1$–$E_5$ behind the target areas $A_1$–$A_5$ in which the dart becomes embedded. This interference will disrupt and change the incoming signal which reaches the signal receiving element in the target area in which the dart is embedded. This change or alteration will be read by the microprocessor 22 to detect the presence of the dart D and determine its location. Once detection and location have occurred, the signal may be further processed by the microprocessor 22 to calculate the appropriate score, and that score may be displayed on an appropriate screen or the like (not shown).

If a dart becomes embedded in the location shown by the ×30, as shown in FIG. 1 adjacent the borders of two adjacent singles scoring areas $A_1$, the voltage signal generated from the scoring area $A_1$ in which the dart is embedded by its signal receiving element $E_1$ will become greater, and will give an accurate reading as to the correct scoring area location of the dart. Reliability and accuracy in this instance is excellent and the system is readily capable of discriminating whether the dart is in fact in the scoring area $A_1$ as depicted by the ×30 in FIG. 1 and not in the adjacent single scoring area even though the embedded dart is very close to that next adjacent area. This is because the magnitude of the total area of each of the two adjacent signal receiving elements $E_1$ are equal to each other, and therefore discrimination between the two areas will be excellent. However, as previously mentioned, it has been found that the accuracy and reliability of detecting the location of the dart is reduced where a dart becomes embedded in a much smaller doubles scoring area $A_2$ or a triples scoring area $A_3$ and closely adjacent the next adjacent much larger single scoring areas $A_1$ or $A_4$. This is also true of the area differences between the single scoring area $A_4$ and the bull scoring area $A_5$. This reliability and accuracy is also diminished if the dart becomes embedded in one of the singles scoring areas, but closely adjacent its next smaller adjacent scoring area $A_2$ or $A_3$. This reliability and accuracy error is still further compounded depending upon whether the embedded dart is only embedded to a shallow depth or instead is embedded to a deeper depth.

More specifically, it has been found that the voltage generated by the signal receiving elements of the smaller size areas $A_2$, $A_3$, $A_5$ is substantially greater than the voltage generated by their adjacent signal receiving elements of the much larger singles scoring areas $A_1$ and $A_3$ when the dart is only embedded to a shallow depth. However, this condition changes and may even reverse in a non-linear, non-proportional fashion as the dart becomes more deeply embedded. More specifically, as the dart becomes more deeply embedded given the same location, the voltage of the larger signal receiving elements $E_1$ or $E_4$ becomes substantially greater and in the smaller area elements $E_2$, $E_3$, $E_5$ becomes substantially diminished. Thus, the possibility is substantially increased that an erroneous location reading might occur. For example, where the dart D is actually embedded at the location indicated by the ×32 in FIG. 1 in an area $A_2$, but closely adjacent area $A_1$, the location read may actually be in error as being in $A_1$ and result in an erroneous single score rather than a double score. Conversely, where the dart is actually embedded at the location indicated by the ×34 in FIG. 1 in area $A_1$, the location may actually be read in error as being in the area $A_2$ and result in an erroneous double score rather than a correct single score. This is due to the large difference in magnitude of area sizes between the target area $A_1$ and $A_2$ and their signal receiving elements $E_1$ and $E_2$. Because of these area size differences and the non-linear changes in voltages between deep and shallow depth darts, the voltage produced by the smaller signal receiving element $E_2$ may actually be larger than the voltage produced by the larger element $E_1$. This can result in an erroneous indication that the dart is in area $A_2$ when it is actually in area $A_1$, or vice versa.

It has been discovered in the present invention that if the large magnitude area size signal receiving elements $E_1$ and $E_4$ are broken into electrically distinct sensing portions, and in which the electrically distinct sensing portions most closely adjacent the small signal receiving elements $E_2$, $E_3$ and $E_5$ are substantially equal in magnitude of area size to those small area elements $E_2$, $E_3$ and $E_5$, reliability and accuracy of missile or dart location detection will be substantially enhanced and closely approach 100%.

More specifically and with reference to FIG. 3, the signal receiving element $E_1$ is shown as having been divided into three electrically distinct sensing portions. Signal receiving element sensing portion $E_{1a}$ which is most closely adjacent to the small signal receiving element $E_2$ is of substantially the same magnitude of area size as element $E_2$, and the signal receiving element portion $E_{1c}$ is of substantially the same magnitude of area size as its most closely adjacent small signal receiving element $E_3$. The remaining portion of the total area size of the signal receiving element $E_1$, more specifically portion $E_{1b}$ constitutes the remainder of the total area of the large signal receiving element $E_1$. Likewise, the large signal receiving element $E_4$ is also shown as divided into electrically distinct signal receiving element sensing portion $E_{4a}$ which is most closely adjacent to the small signal receiving element $E_3$, signal receiving element portion $E_{4c}$ which is most closely adjacent the signal receiving element $F_5$, with the remainder of the signal element $E_4$ being constituted by the electrically distinct portion $E_{4b}$. Finally, the presence of a dart embedded in the non-scoring ring area 36 is also detected and scored as a zero score. The non-scoring area 36 also includes a comparable electrically distinct signal receiving sensing portion $E_{ns}$ adjacent the small signal receiving element $E_2$ and which is of the same magnitude of area size as element $E_2$.

By way of example and not considered or intended to be limiting to the present invention, the total area of the signal receiving elements $E_1$ including their sensing portions $E_{1a}$, $E_{1b}$ and $E_{1c}$ may be approximately 2100 square millimeters. The total area of the signal receiving elements $E_4$ including their sensing portions $E_{4a}$, $E_{4b}$ and $E_{4c}$ may be approximately 1360 square millimeters. The areas of the signal receiving elements and sensing portions $E_{ns}$, $E_2$ and $E_{1a}$ may each be approximately 330 square millimeters. The areas of the signal receiving elements and sensing portions $E_{1c}$, $E_3$ and $E_{4a}$ may each be approximately 200 square millimeters. And, signal receiving elements and sensing portions $E_{4c}$ and $E_5$ may be approximately 125 square millimeters in a typical dart board.

It has been found that by the division of the electrically distinct signal receiving element sensing portions of the larger single scoring signal receiving elements $E_1$ and $E_4$ of target areas $A_1$ and $A_4$ which are adjacent to the small signal receiving elements $E_2$, $E_3$, and $E_5$ as shown and described, the voltage signal response is substantially enhanced at the borders of the target area in which the dart is actually embedded. This is because the voltage signals become essentially linear in change as the depth of the dart changes, and also because of the reduction in magnitude of disparity in area sizes between adjacent target areas which are otherwise of quite disparate area size. Thus, the reliability and accuracy of the correct identification of location of where the darts are actually embedded in for example the locations 32, 34 as shown in FIG. 1, is enhanced to a level of reliability and accuracy which approaches that which is enjoyed where the dart is embedded in the location 30, as shown in FIG. 1. This is due to the substantial equality in magnitude of area sizes of the two adjacent signal sensing elements as at location 30 or the elements and the sensing portions as in the invention.

It will be understood that the preferred embodiment of the present invention which has been described is merely illustrative of the principles of the invention. Numerous modifications may be made by those skilled in the arts without departing from the true spirit and scope of the invention.

I claim:

1. A system for the accurate location of a missile embedded in a target, comprising:

a target having a target face, said target face having a plurality of target areas formed of material into which one or more of the missiles may be selectively embedded; said target areas including a first target area which has a first magnitude of area size and a second target area which is adjacent to said first target area and which has a second magnitude of area size which is substantially larger than said first magnitude of area size;

signal receiving elements associated with respective ones of said target areas for receiving and sensing electromagnetic signals which are received at each of said target areas when a missile is embedded in or near respective ones of said target areas; said signal receiving elements being positioned on a side of said material opposite said target face and substantially conforming in size and shape to each of said target areas, said signal receiving element of said first target area having an area size which is substantially equal in magnitude to said first magnitude of area size, and said signal receiving element of said substantially larger second target area having a total area size which is substantially equal to said second magnitude of area size, but including a signal sensing portion which is electrically distinct from the signal receiving element of said first target area and also electrically distinct from the remainder of the total area of the signal receiving element of said second target area; and processing means electrically connected to said signal receiving elements and said sensing portion which is electrically distinct from the remainder of the total area of the signal receiving element of said second target area, said processing means distinguishing between a first electromagnetic signal which is received and sensed by one of said signal receiving elements or said signal sensing portion, and a second electromagnetic signal which results from the presence of a missile in close proximity to said target area of said one of said signal receiving elements or said sensing portion, wherein the close proximity of the missile permits the accurate detection of the location of the missile.

2. The system of claim 1, wherein said electrically distinct signal sensing portion of said signal receiving element of said second target area is adjacent to said signal receiving element of said first target area.

3. The system of claim 2, wherein the magnitude of the area size of said electrically distinct signal sensing portion is substantially equal to said first magnitude of area size.

4. The system of claim 1, wherein the magnitude of the area size of said electrically distinct signal sensing portion is substantially equal to said first magnitude of area size.

5. The system of claim 1, wherein said target is a dart board.

6. The system of claim 5, wherein said first target area is an area in which a double or triple score is awarded if a dart is embedded in said first target area, and said second target area is an area in which only a single score is awarded if a dart is embedded in said second target area.

7. The system of claim 2, wherein said target is a dart board.

8. The system of claim 3, wherein said target is a dart board.

* * * * *